US007028480B2

(12) United States Patent
Sekiai et al.

(10) Patent No.: US 7,028,480 B2
(45) Date of Patent: Apr. 18, 2006

(54) STEAM TEMPERATURE CONTROL SYSTEM, METHOD OF CONTROLLING STEAM TEMPERATURE AND POWER PLANT USING THE SAME

(75) Inventors: Takaaki Sekiai, Hitachi (JP); Satoru Shimizu, Hitachi (JP); You Oosawa, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/148,553

(22) Filed: Jun. 9, 2005

(65) Prior Publication Data

US 2005/0274113 A1 Dec. 15, 2005

(30) Foreign Application Priority Data

Jun. 11, 2004 (JP) ..... 2004-174557

(51) Int. Cl.
*F01K 13/02* (2006.01)

(52) U.S. Cl. ..... 60/646; 60/657; 60/660; 60/670

(58) Field of Classification Search ..... 60/646, 60/657, 660, 670, 679
See application file for complete search history.

(56) References Cited

U.S. PATENT DOCUMENTS

| | | | | |
|---|---|---|---|---|
| 3,948,043 | A * | 4/1976 | Martz | 60/243 |
| 3,953,966 | A * | 5/1976 | Martz et al. | 60/783 |
| 4,031,404 | A * | 6/1977 | Martz et al. | 290/40 R |
| 4,333,310 | A * | 6/1982 | Uram | 60/39.182 |
| 4,578,944 | A * | 4/1986 | Martens et al. | 60/39.182 |
| 6,912,855 | B1 * | 7/2005 | Bescherer et al. | 60/772 |

FOREIGN PATENT DOCUMENTS

| | | |
|---|---|---|
| JP | 10-38213 | 2/1998 |
| JP | 2002-215205 | 7/2002 |

* cited by examiner

*Primary Examiner*—Hoang Nguyen
(74) *Attorney, Agent, or Firm*—Dickstein Shapiro Morin & Oshinsky LLP

(57) ABSTRACT

A steam temperature control system for a power plant for controlling a temperature of steam flowing through steam pipes connected to a heat exchanger to a target temperature by spraying water by means of a spray valve of an attemperator, having a target temperature calculation section for calculating the target temperature of the steam for determining the target temperatures of the plural steam pipes connected to the heat exchanger in respective steam pipes connected to a common heat exchanger; and an instruction value calculation section for calculating command values to the spray valves disposed to the respective steam pipes, based on the target temperatures determined by the calculation in the target temperature calculating section.

12 Claims, 11 Drawing Sheets

| 400 | 401 | 402 | 403 | 404 | 405 | 406 | 407 | 408 | | |
|---|---|---|---|---|---|---|---|---|---|---|
| TIME | P01 | P02 | P03 | P04 | T01 | T02 | T03 | T04 | · · · | 410 |
| YEAR/MONTH/DAY, HOUR, MINUTE, SECOND | MPa | MPa | MPa | MPa | ℃ | ℃ | ℃ | ℃ | · · · | 420 |
| 2004/01/01 12:00:00 | 18.5 | 18.4 | 23.4 | 23.4 | 428.2 | 424.2 | 524.2 | 526.2 | · · · | 430 |
| 2004/01/01 12:00:01 | 18.8 | 18.4 | 23.4 | 23.4 | 427.2 | 425.2 | 525.2 | 527.2 | · · · | |
| 2004/01/01 12:00:02 | 18.7 | 18.5 | 23.5 | 23.5 | 426.0 | 425.0 | 525.0 | 528.0 | · · · | |
| · · · | · · · | · · · | · · · | · · · | · · · | · · · | · · · | · · · | · · · | |

STEAM TEMPERATURE SETTING VALUE AT THE EXIT OF THE SECONDARY SUPERHEATER

SPRAY FLOW RATE CALCULATION VALUE OF ATTEMPERATOR OF SECONDARY SUPERHEATER

SPRAY FLOW RATE CALCULATION VALUE OF ATTEMPERATOR OF TERTIARY SUPERHEATER

EVALUATION VALUE

STEAM TEMPERATURE CONTROL SYSTEM, METHOD OF CONTROLLING STEAM TEMPERATURE AND POWER PLANT USING THE SAME

CLAIM OF PRIORITY

The present application claims priority from Japanese patent application Serial No. 2004-174557, filed Jun. 11, 2004, the content of which is hereby incorporated by reference into this application.

1. Field od the Invention

The present invention relates to a system and a method of controlling steam temperature of steam flowing through steam pipes connected to a heat exchanger by spraying spray water by means of a spray valve of an attemperator to a target temperature, and to a power plant using the system and the method.

2. Related Art

An example of power plants that have a function of controlling a steam temperature of steam flowing through a heat exchanger or steam pipes to a target temperature is a thermal power plant.

The thermal power plant generates electricity by driving a steam turbine with high temperature, high pressure steam that is produced by heating feed water circulating in a heat exchanger in a boiler of the power plant with high temperature combustion gas generated by combustion of fuel and air.

In the thermal power plant, the heat exchanger is connected with other heat exchangers or a turbine are connected, in general, by means of steam pipes; there is a case where an entrance and an exit of a heat exchanger are connected with steam pipes. For example, if directions that transverse a direction of gas flow is defined as a right and left direction of the boiler, and if the steam pipes are connected to the entrance and exit of the heat exchanger from right and left sides, steam that enters an entrance header of the heat exchanger from right side passes through the right side of the heat exchanger, passes through the pipes on the right side and leaves the heat exchanger from the exit. Steam that enters the entrance header of the heat exchanger from left side passes through the left side and leaves the heat exchanger from left side.

There are cases where the steam pipes connected with the heat exchanger are provided with an attemperator for controlling a steam temperature by spraying spray water to a target temperature. The attemperator increases an amount of spray water if the steam temperature is higher than a target temperature, but if the temperature is lower than the target temperature, it lowers an amount of spray water. An amount of spray water can be controlled by adjusting an opening degree of the spray valve of the attemperator. Prior art relating to controlling an attemperator spray valve is as follows.

As a typical example, there is exemplified a feed-back control method (refer to patent document No. 1) wherein the spray valve is controlled based upon a deviation between a main steam temperature and a target temperature. Another example is a prediction control method (refer to patent document No. 2) wherein a prediction means comprising a plant simulation means, a simulation means for control means and prediction means consisting of non-interference control means for independently controlling process control amounts, which interfere each other, wherein preceding control commands are calculated by the non-interference control means from the process control amounts predicted by the both simulation means.

In the conventional technologies mentioned above, one steam temperature target value is set with respect to one heat exchanger so that the spray valve of the attemperator is controlled by using the steam temperature target value.

Using these conventional technologies, the spray valves of the attemperator comprising two steam pipes being connected respectively to an entrance and exit of the heat exchanger and spray valves connected to the two steam pipes, which are connected to the entrance of the steam pipes are controlled so as to make the steam temperature of steam flowing through the steam pipes connected to the exit of the heat exchanger coincide with the target temperature.

There are two control methods (i), (ii) for achieving the above-mentioned requirements.

(i) $V_1$ is determined so as to make $T_1=T_c$ and $V_2$ is determined so as to make $T_2=T_c$.

(ii) $V_1=V_2$ are determined so as to make $(T_1+T_2)/2=T_c$.

In the above, $T_1$ is a temperature of steam passing through the steam pipes at the right side exit of the heat exchanger; $T_2$ is a temperature of steam passing through the steam pipes at the left side exit of the heat exchanger; $V_1$ an opening degree of the spray valve disposed at the left side exit of the heat exchanger; $V_2$ is an opening degree of the spray valves temperature of the attemperator, the spray valves being disposed at the right side entrance of the heat exchanger; $T_c$ is the target temperature of the steam temperature at the exit of the heat exchanger.

In the control method (i) above, the steam temperature $T_1$ of steam that passes through the steam pipes at the right side of the exit of the heat exchanger is controlled by the attemperator disposed at the right side of the entrance of the heat exchanger and the steam temperature $T_2$ of steam that passes through the steam pipes at the left side of the exit of the heat exchanger by the attemperator disposed at the left side of the entrance of the heat exchanger, whereby $T_1$ and $T_2$ are made coincide with the target temperature $T_c$.

On the other hand, in the control method (ii) above, the degree of opening of the right and left spray valves of the attemperator spray connected to the steam pipes, which are connected to the entrance header of the heat exchanger are coincided with each other; an average value of difference between $T_1$ of steam that passes through the left side exit of the heat exchanger and $T_2$ of steam that passes through the left exit are coincided with the target $T_c$ of steam temperature at the exit of the heat exchanger.

Patent document No. 1; Japanese patent laid-open 10-38213

Patent document No. 2; Japanese patent laid-open 2002-215205

DESCRIPTION OF THE INVENTION

For example, if gas temperature flowing in a boiler becomes non-uniform between a right side direction and a left side direction upon ignition and blowing-out, there may be difference in thermal adsorption quantity between the passages in the heat exchanger, even though steam passes through one heat exchanger. If a gas temperature at right side of the boiler becomes higher than that of the gas at the left side, a thermal adsorption quantity of steam passed through the left side of the heat exchanger becomes larger than that of the steam passed through the right side.

In such case, in order to attain the relation $T_1=T_2=T_c$ by the aforementioned method, it is necessary to lower the steam temperature at the entrance of the right side of the heat exchanger more than the steam temperature at the exit of the left side of the heat exchanger by spraying water of an amount in the attemperator disposed at the entrance of the right side of the heat exchanger more than that at the attemperator disposed at the entrance of the left side of the heat exchanger.

As a result, the spray valve degree $V_2$ of the attemperator disposed at the steam pipes at the right side entrance of the heat exchanger becomes larger; an allowance for operation limits of the attemperator and the spray valves will be lost. If the allowance for the operation limits of the attemperator and the spray valves are small, there may be difficulty in suppressing the increase in the steam temperature caused by a load change operation.

Further, when an average value of steam temperature of the right and left side is the target temperature under the premise of $V_1=V_2$, there is a relationship $T_1>T_2$, since the amount of the steam flowing the right side and the left side of the heat exchanger is the same. As a result, $T_1$ becomes higher than the limit value of the steam temperature, which leads to damage of the steam pipes.

The present invention has been made in view of the above problems; an object of the present invention is to provide a steam temperature control system, a steam temperature control method and a power plant using the same, wherein keeping allowance for operation limit, a control performance for steam temperature at load change operations is improved, and wherein a local increase of the steam temperature to a temperature higher than the limit temperature of the heat exchanger is prevented so as to avoid damage to the steam pipes.

DESCRIPTION OF THE INVENTION

In order to attain the object, the present invention determines steam temperature target values of the respective steam pipes connected to the common heat exchanger; based upon the steam temperature target values, the control demands to the spray valves disposed to the respective steam pipes are calculated.

According to the present invention, it is possible to improve control performance of the steam temperature at the time of load change operation since allowance for the operation limits of the attemperator is secured; since the local increase of the steam temperature is prevented from going over the limit temperature of the heat exchanger, whereby the damage to the steam pipes is avoided.

EXPLANATION OF REFERENCE NUMERALS

51; steam pipe, 101; boiler, 102; primary heat exchanger, 103; secondary heat exchanger, 104; tertiary heat exchanger, 107, 107*a, b*; attemperator, 108, 108*a, b*; attemperator, 109, 109*a, b*; spray vale 110, 110*a, b*; spray valve, 200; steam temperature control apparatus, 510; steam temperature target value calculation section, 520; spray control command value calculation section,

PREFERRED EMBODIMENTS OF THE INVENTION

In the following, the embodiments of the present invention will be explained by reference to drawings.

In this embodiment, the present invention will be explained by way of an example of a thermal power plant. The power plant in this embodiment has a function for controlling steam temperature flowing the steam pipes connected to the heat exchanger by spraying spray water by means of spray valves of the attemperator to a target temperature.

Figure 1:
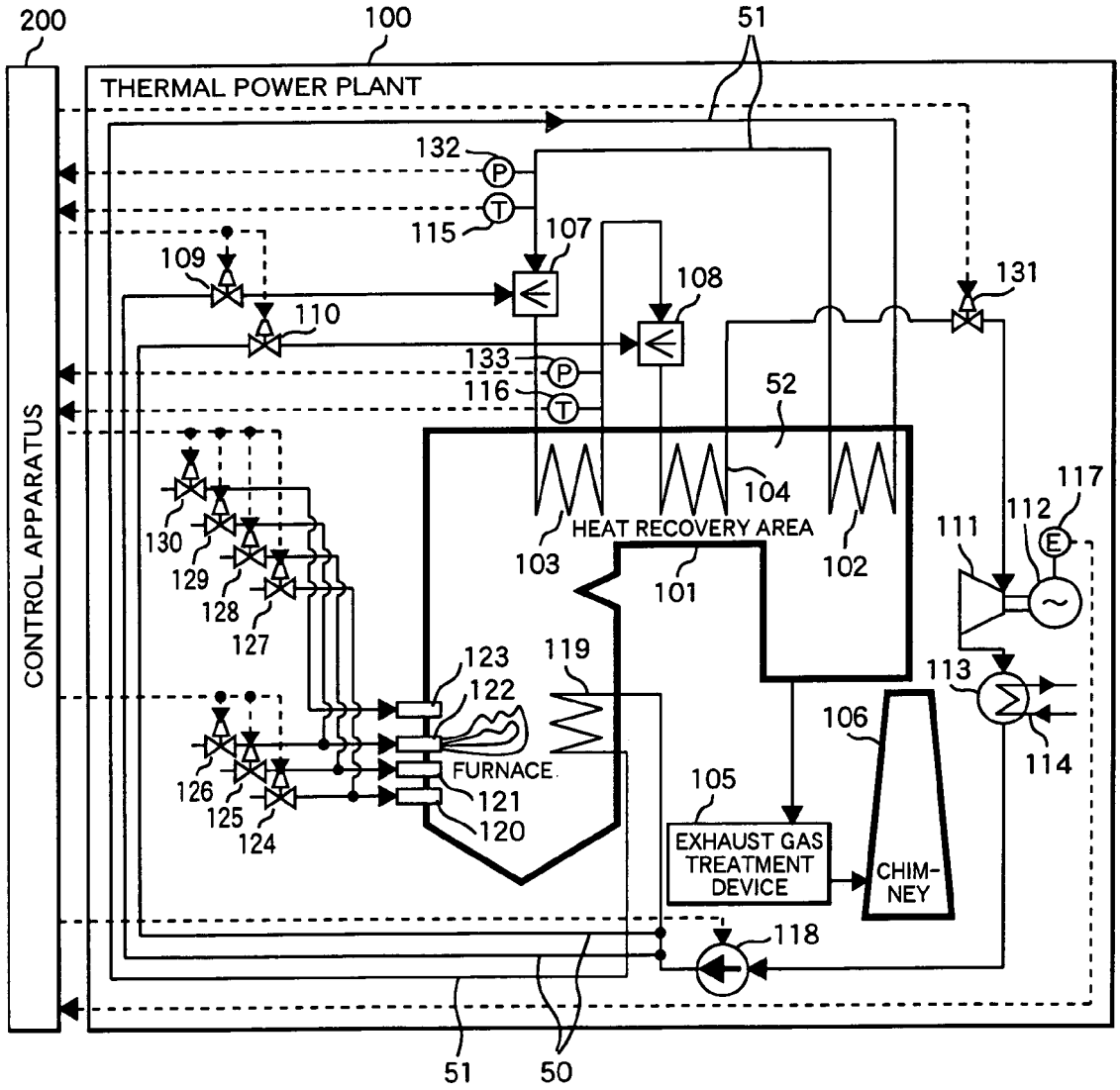
FIG. 1 is a diagram of a power plant of one embodiment of the present invention.

FIG. 1 is a block-diagram showing the whole constitution of an embodiment of a power plant; the power plant will be explained by using FIG. 1.

In the power plant 100 shown in FIG. 1, fuel such as coal or biomass, etc and primary air for transporting the fuel are supplied from burners 120–122 and secondary air for combustion adjustment is supplied from air-port 123 to a furnace of a boiler 101 as a thermal source to generate steam by heating feed water. The fuel, primary air and secondary air are heated and combusted in the furnace to produce high temperature gas. The gas passed through the boiler 101 is sent to an exhaust gas treatment apparatus 105 so as to remove pollution components contained therein, followed by being discharged from a chimney 106 to the air.

Feed water is supplied and circulated to the boiler 101 by means of a feed water pump 118. A part of this feed water is drawn out by means of spray conduit 50 as spray water; then it is heated at the water wall 119 to be vaporized. The resulting steam is further heated in the steam pipes 51 by the gas passing through the chimney section 52 during the time for passing through the primary heat exchanger 102, secondary heat exchanger 103 and tertiary heat exchanger 104 thereby to elevate temperature and pressure thereof.

The high-temperature and high pressure steam is introduced into the turbine 111 by means of a main stream control valve 131 to drive the turbine 111. A shaft driving force of the turbine 111 is transmitted to a generator 112 to convert it to electric energy by the generator 112. Steam passed through the turbine 111 is condensed by cooling with cooling water 114 during it passes through a condenser 113. Water that passed trough the condenser 113 is circulated to the feed water pump 118 and is again supplied to the boiler 101.

In order to control the steam temperature at the exits of the secondary heat exchanger 103 and tertiary heat exchanger 104, attemperators 107, 108 are disposed at entrances of the secondary heat exchanger 103 and tertiary heat exchanger 104. When spray water sprayed from the attemperators 107, 108 is mixed with steam passing through the steam pipe 51, the steam temperature is lowered.

Though not shown in FIG. 1, steam that has passed through the turbine 111 is again introduced into the boiler 101; the steam is again heated in the boiler 101. There may be disposed further a reheating system for driving a low pressure turbine with the re-heated steam. In this embodiment, although the attemperators are disposed at the entrances of the secondary heat exchanger 103 and tertiary heat exchanger 104, they may be disposed at other places such as the entrance of the primary heat exchanger 102.

An operating condition of the thermal power plant is detected by data detecting devices such as steam temperature thermometers 115, 116 disposed at the entrances and exits of the secondary heat exchanger 103, steam pressure gauges 132, 133 disposed at the entrance and exit of the secondary heat exchanger 103, and a generator output measuring device 117 disposed to the generator 112.

The data detected by the data detecting devices is transmitted to control device 200. Though not shown in figures, various kinds of data detecting devices for detecting different process values are disposed to the thermal power plant 100. The data detected by the other devices is also input into the control device 200.

In the control device 200, the operation condition of the thermal power plant 100 is acquired based on the input data from these data detection devices and control command values with respect to the control devices are produced and transmitted to the thermal power plant so that the operation condition of the thermal power plant becomes good. In this method, control devices include fuel flow rate control valves 124–126 disposed to fuel supply conduits of the burners 120–122, air flow rate adjusting valves 127–129 disposed to air supply conduits of the burners 120, an air flow rate adjusting valve 130 disposed to an air supply conduit of an air port 123, spray flow rate valves 109, 110 disposed to water supply conduits of the attemperators 107, 108, a turbine governor 131 disposed to the feed water entrance of the steam pipe 51 to the turbine 111 and the feed water pump 118, etc.

Next, a structure of the boiler 101 will be explained by reference to FIG. 2.

Figure 2:
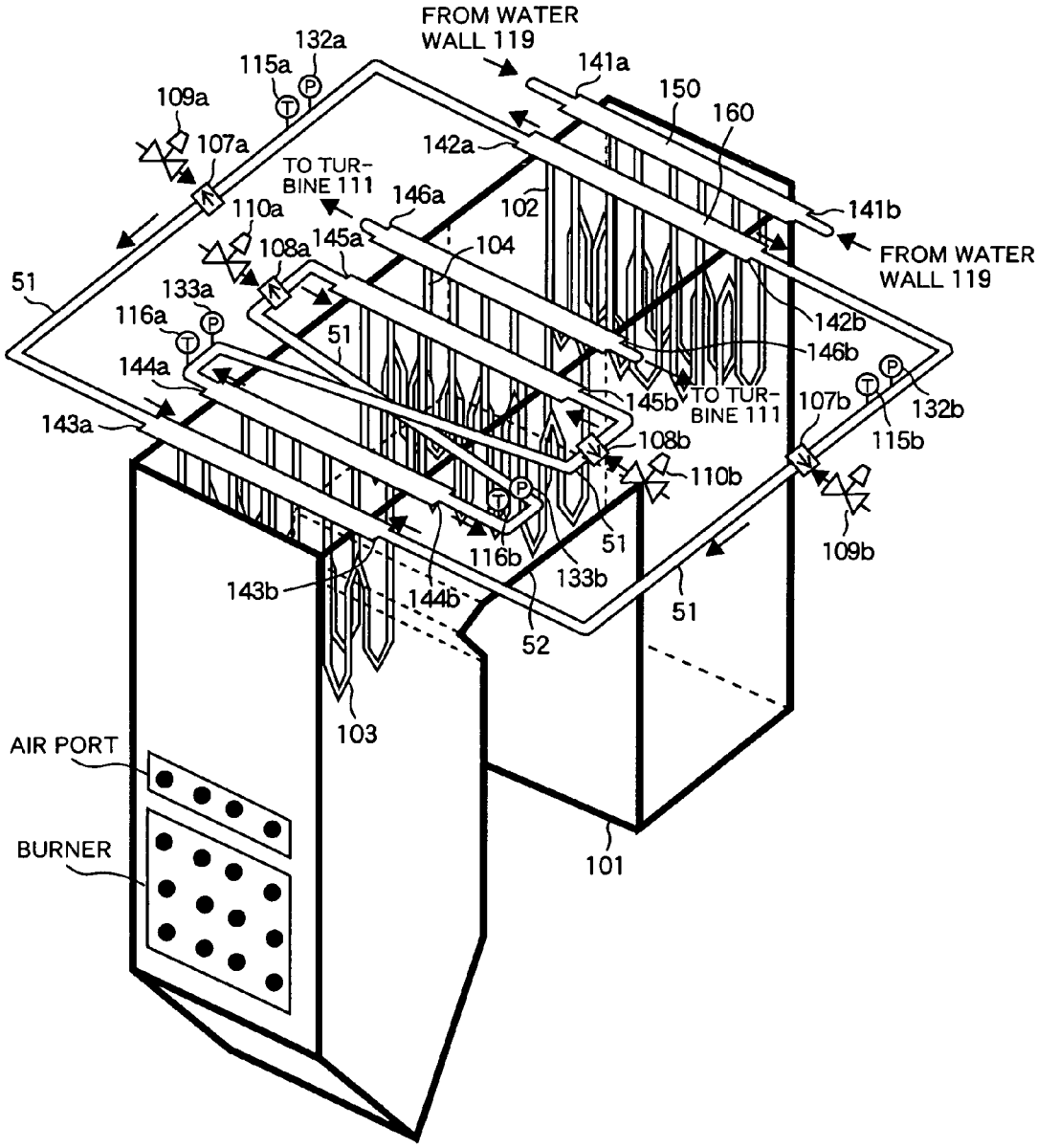
FIG. 2 is a three dimensional view of a boiler disposed to the above power plant of the embodiment of the present invention.

FIG. 2 is a perspective view or a three dimensional structure of the boiler 101. The reference numerals denote the same members as in the previous figures. In FIG. 2, a right hand direction and left hand direction of boilers 101 that are perpendicular to the gas flow direction (in the figure, right hand upper side direction) in the boiler 101 (chimney 52) are defined as right hand and left hand directions; the left hand side with respect to the center of the right hand and left hand center is defined as a cycle, and right hand side is defined as b cycle. For the sake of explanation, the components of the a cycle and b cycle are explained by reference numerals with suffixes a and b, respectively.

As shown in FIG. 2, steam pipes 51 (in this embodiment, two pipes) are connected to the primary heat exchanger through tertiary heat exchanger 102–104 from both right hand and left hand. Steam enters the common heat exchanger through the two steam pipes connected to the entrance header from the right hand and left hand. Steam after being heated flows out as divided flows from the steam pipes connected to the right hand and left hand of the common heat exchanger.

As for the primary heat exchanger 102, steam that has passes through the water wall 119 arrives at the entrance header 150 of the primary heat exchanger 102 by way of the two steam pipes 51 from the right hand and left hand; the steam that flows into divided flows in the heat exchanger 102 is introduced into the chimney 52 in the boiler 101 and heated there.

Steam that flows into from the left hand entrance 141*a* of the entrance header 150 flows out from the left hand exit 142*a* of the exit header 160 of the primary heat exchanger 102; steam that flows into from the right hand entrance 141 flows out from the right hand exit 142*b*.

Figure 3:
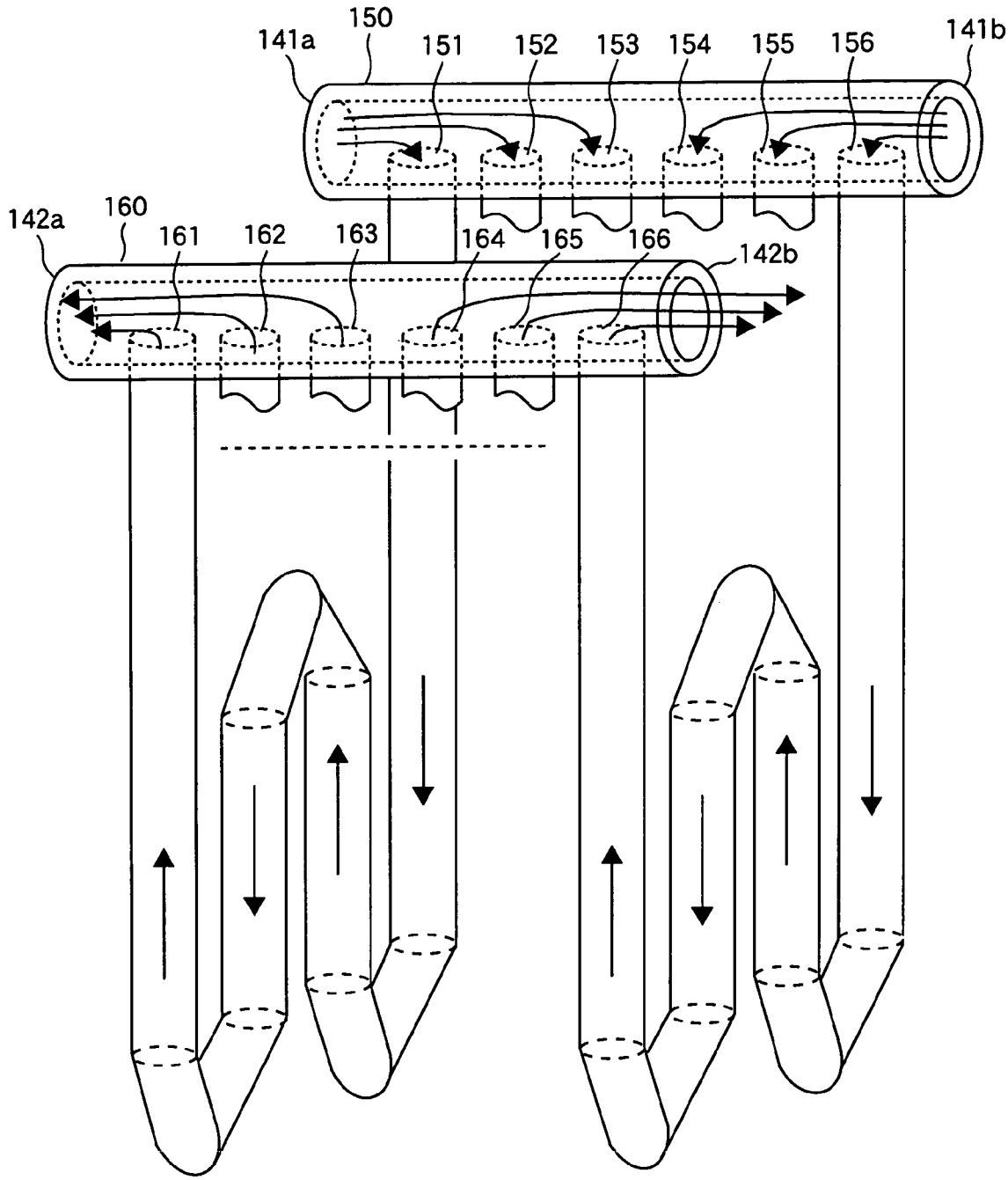
FIG. 3 is a perspective view of a heat exchanger disposed to the embodiment of the present invention.

FIG. 3 is an enlarged figure of a detailed structure of the primary heat exchanger 102. The same reference numerals denote the same members as in previous drawings.

As shown in FIG. 3, steam that has passed through the left hand entrance 141*a* flows into the header 150 of the primary heat exchanger 102 from the left hand entrance 141*a* and right hand entrance 141*b*. Steam that enters from the left hand entrance 141*a* flows as divided flows into the conduits 151, 152, 153; after passing through the space in the chimney 52 of the boiler 101, it arrives at the exit header 160 of the primary heat exchanger 102 and flows out from the left hand exit 142*a*.

On the other hand, steam that has entered from the right hand entrance 141*b* flows as divided flows into the conduits 156, 155, 154; after passing through the space in the chimney 52 of the boiler 101, it arrives at the exit header 160 of the primary heat exchanger 102 by way of conduits 166, 165, 164, respectively, and flows out from the right hand exit 142*b*. As is explained, in the primary heat exchanger 102, steam that has flown into from the left hand entrance 141*a* mainly flows out from the left hand exit 142*a*; steam that has flown into from the right hand entrance 141*b* mainly flows out from the right hand exit 142*b*.

The basic structures of the secondary heat exchanger 103 and the tertiary heat exchanger 104 are the same as in the primary heat exchanger 102 shown in FIG. 3. That is, in the secondary heat exchanger 103, steam that has flown into from the left hand entrance 143*a* flows out from the left hand exit 144*a*; steam that has flown into from the right hand entrance 143*b* flows out from the right hand exit 144*b*.

Even in the tertiary heat exchanger 104, steam that has flown into from the left hand entrance 145*a* flows out from the left hand exit 146; steam that has flown into from the right hand entrance 145*b* flows out from the right hand exit 146*b*.

The attemperators 107, 108 each comprises a pair of attemperators 107*a*, 107*b* and 108*a*, 108*b*, the a cycle and b cycle being disposed to the steam pipes 51. That is, as shown in FIG. 2, the steam pipe of the right hand and left hand steam pipes 51 connecting the primary heat exchanger 102 and the secondary heat exchanger 103 in the a cycle is provided with the attemperator 107*a* having the spray valve 109*a*, and the steam pipes 51 connecting the primary heat exchanger 102 and the secondary heat exchanger 103 in the b cycle is provided with the attemperator 107*b* having the spray valve 109*b*.

Similarly, the steam pipe of the right hand and left hand steam pipes connecting the secondary heat exchanger 103 and the tertiary heat exchanger 104 in the a cycle is provided with the attemperator 108*a* having the spray valve 109*a*, and the steam pipe of the steam pipes 51 connecting the secondary heat exchanger 103 and the tertiary heat exchanger 104 in the b cycle is provided with the attemperator 108*b* having the spray valve 110*b*.

Figure 4:
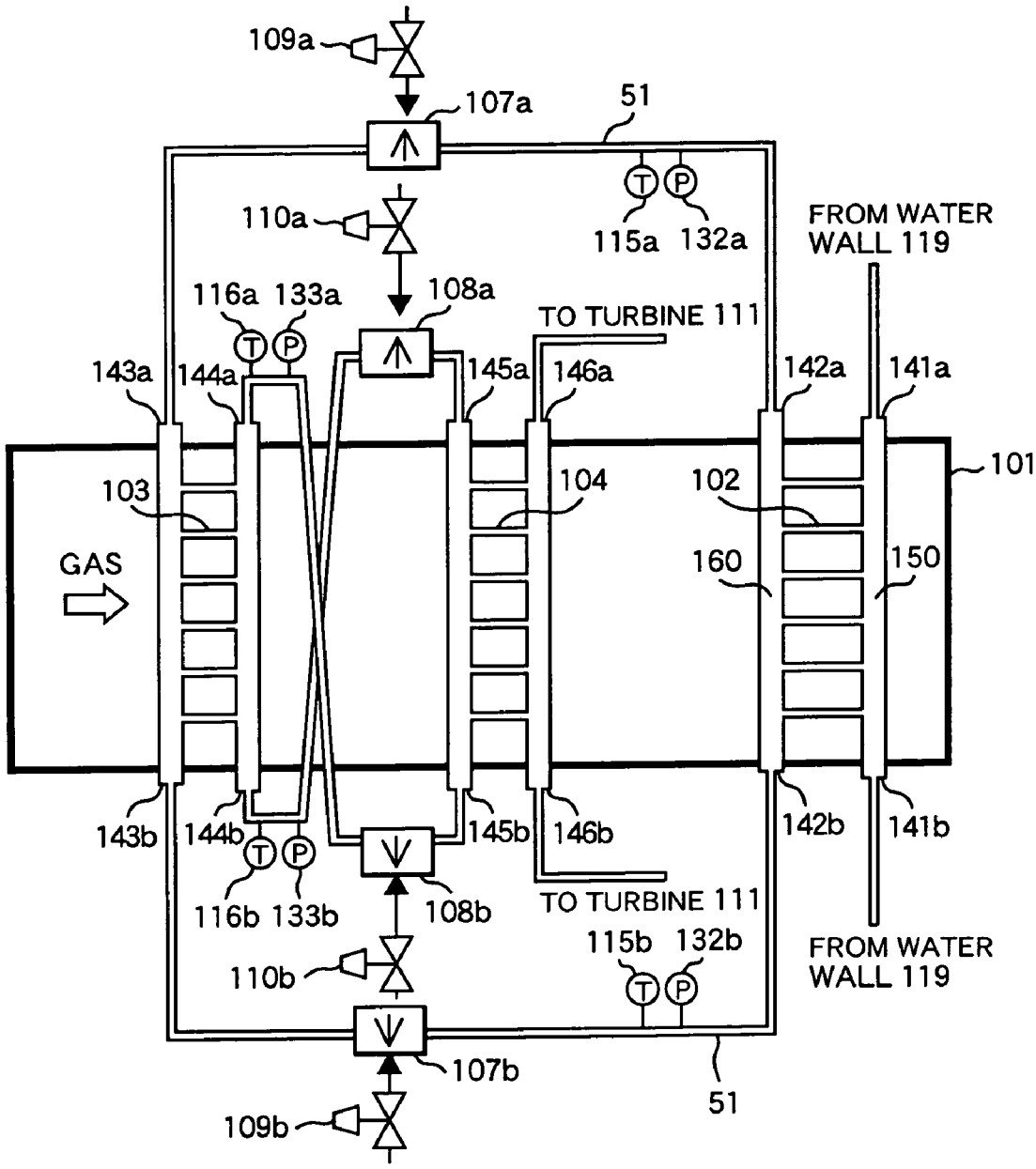
FIG. 4 is a top plan view of the boiler disposed to the embodiment of the present invention.

FIG. 4 is a top plan view of the boiler 101; the same reference numerals denote the same members as in the previous drawings.

Flow of steam in the boiler 101 is explained. In FIG. 4, steam that has entered the header 150 of the primary heat exchanger 102 by way of the left hand entrance 141*a* passes through the following route.

Left hand entrance 141*a*→left hand exit 142*a*→attemperator 107*a*→left hand entrance 143*a*→left hand exit 144*a*→attemperator 108*b*→right hand entrance 145*b*→right hand exit 146*b*

On the other hand, steam that has entered from the right hand entrance 141*b* flows as follows.

Right hand entrance 141*b*→right hand exit 142*b*→attemperator 107*b*→right hand entrance 143*b*→right hand exit 144*b*→attemperator 108*a*→left hand entrance 145*a*→left hand exit 146*a*

In FIGS. 2 to 4, though the number of cycles is two, there may be three, four cycles, etc by increasing the number of division of steam pipes 51.

Next, the control device 200 is explained.

Figure 5:
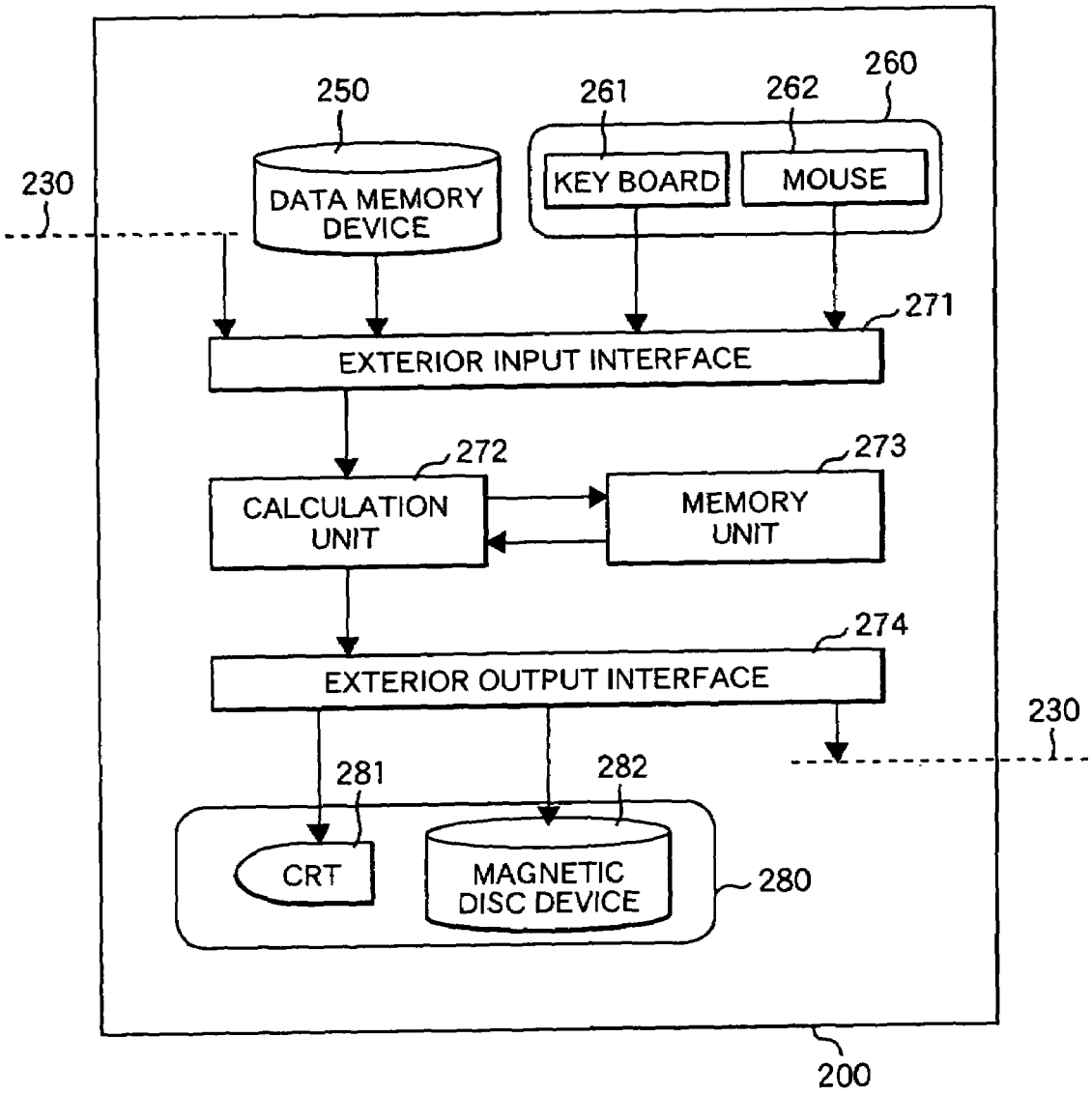
FIG. 5 is a hardware structure of the steam temperature control apparatus of the present invention.

FIG. 5 is a block diagram of a hardware constitution of the control device 200. As shown in FIG. 5, the control device 200 is connected with signal transmission network 230 by way of an external input interface 271, an external output interface 274, and calculate to generate various control signals by means of the calculation processing unit 272, while memorizing received signals in a memory unit 273, if necessary. Command signals are output to the corresponding control units by way of the external output interface 274. Further, the external input interface 271 is provided with an external input device 260 comprising a key board 261 and a mouse 262. The output interface 274 is provided with an output device comprising an image display device 281 and a magnetic disc device 282, which works as an interface for an operator.

The data memory device 250 is stored with design information on boilers, which is necessary for generating command signals such as materials for heat exchangers 102 to 104 and three-dimensional structure of the boiler 101.

A spray calculation model is constituted by physical equations such as the equation of energy conservation, the equation of momentum conservation, etc. In this model, steam temperature target values for the respective steam pipes 51 corresponding to a and b cycles connected to the common heat exchanger are input, and amounts of steam flow rates of steam passing through the heat exchanger are calculated for the respective steam pipes 51.

On the other hand, if the steam temperature-target values detected by the steam temperature detectors 116*a*, 116*b* shown in FIGS. 2 and 4 are set by the external input device 260, the following steam flow rates are calculated.

$G_{142a}$: flow rate of steam passing through the left hand exit 142*a* of the primary heat exchanger 102

$G_{142b}$: flow rate of steam passing through the right hand exit 142*b* of the primary heat exchanger 102

$G_{143a}$: flow rate of steam passing through the left hand exit 143*a* of the secondary heat exchanger 103

$G_{143b}$: flow rate of steam passing through the right hand exit 143*b* of the secondary heat exchanger 103

$G_{144a}$: flow rate of steam passing through the left hand exit 144*a* of the secondary heat exchanger 103

$G_{144b}$: flow rate of steam passing through the right hand exit 144*b* of the secondary heat exchanger 103

$G_{145a}$: flow rate of steam passing through the left hand exit 145*a* of the tertiary heat exchanger 104

$G_{145b}$: flow rate of steam passing through the right hand entrance 145*b* of the tertiary heat exchanger 103

Using the calculation results, a flow rate $G_{107a}$ of spray of the attemperator 107*a* of the secondary heat exchanger, a flow rate $G_{107b}$ of spray of the attemperator 107*b* of the secondary heat exchanger 107*b*, a flow rate $G_{108a}$ of spray of the attemperator 108*a* of the tertiary heat exchanger and a flow rate $G_{108a}$ of spray of the attemperator 108*b* of the tertiary heat exchanger are calculated by the following equations (1) to (4).

$$G_{107a}=G_{143a}-G_{142a} \quad (1)$$

$$G_{107b}=G_{143b}-G_{142b} \quad (2)$$

$$G_{108a}=G_{145a}-G_{144b} \quad (3)$$

$$G_{108b}=G_{145b}-G_{144a} \quad (4)$$

In the data memory unit 250, there are stored the spray flow rate calculation models for calculating necessary spray flow rates, based upon steam temperature target values at the exit of the heat exchanger.

Figures 6, 7:
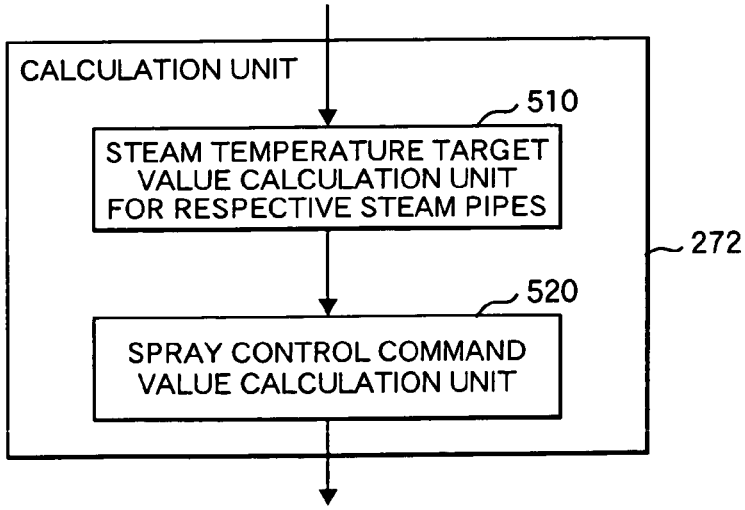
FIG. 6 is a format of data stored in a memory device disposed to the embodiment of the present invention.
FIG. 7 is a block diagram of a calculation section the steam temperature control apparatus of the present invention.

FIG. 6 is a table showing calculation examples of detected data memorized in the memory unit 273. As shown in Table, detection data from the thermal power plant 100 such as process values (line 430) detected at each measuring time (column 400) for detector numbers (line 410) are stored together with units (line 420) in the memory Unit 273. For example, data detected by the steam pressure gauges 132*a*, 132*b*, 133*a*, 133*b* is stored in lines 401, 402, 403, 404, respectively; data detected by the steam thermometers 115*a*, 115*b*, 116*a*, 116*b* is stored in columns 405, 406, 407, 408.

As mentioned above, different detection values for each detector at each detection time are stored in the memory unit 273 as a table format.

In the above mentioned calculation section 272 (refer to FIG. 5), a command value (command signal) for each control device is generated at every calculation cycle. FIG. 7 is a block diagram showing an outline of the calculation section in FIG. 5.

As shown in FIG. 7, the calculation section 272 is provided with a steam temperature target value calculation section 510 for determining a steam temperature target value of the respective steam pipes 51 connected to the common heat exchanger and a spray control command value calculation section 520 for outputting control command values to spray valves disposed to the respective steam pipes 51 connected to the common heat exchanger, based upon the steam temperature target values determined by the steam temperature target value calculation unit 510.

In the above temperature target value calculation section 510, the steam temperature target value is determined by taking into consideration the allowance for operation of the opening degree of the spray valve and the limit value of steam temperature, when comparing values of evaluation function Q(k) whose variant is deviation of flow rates of spray water with a threshold value.

Figure 8:
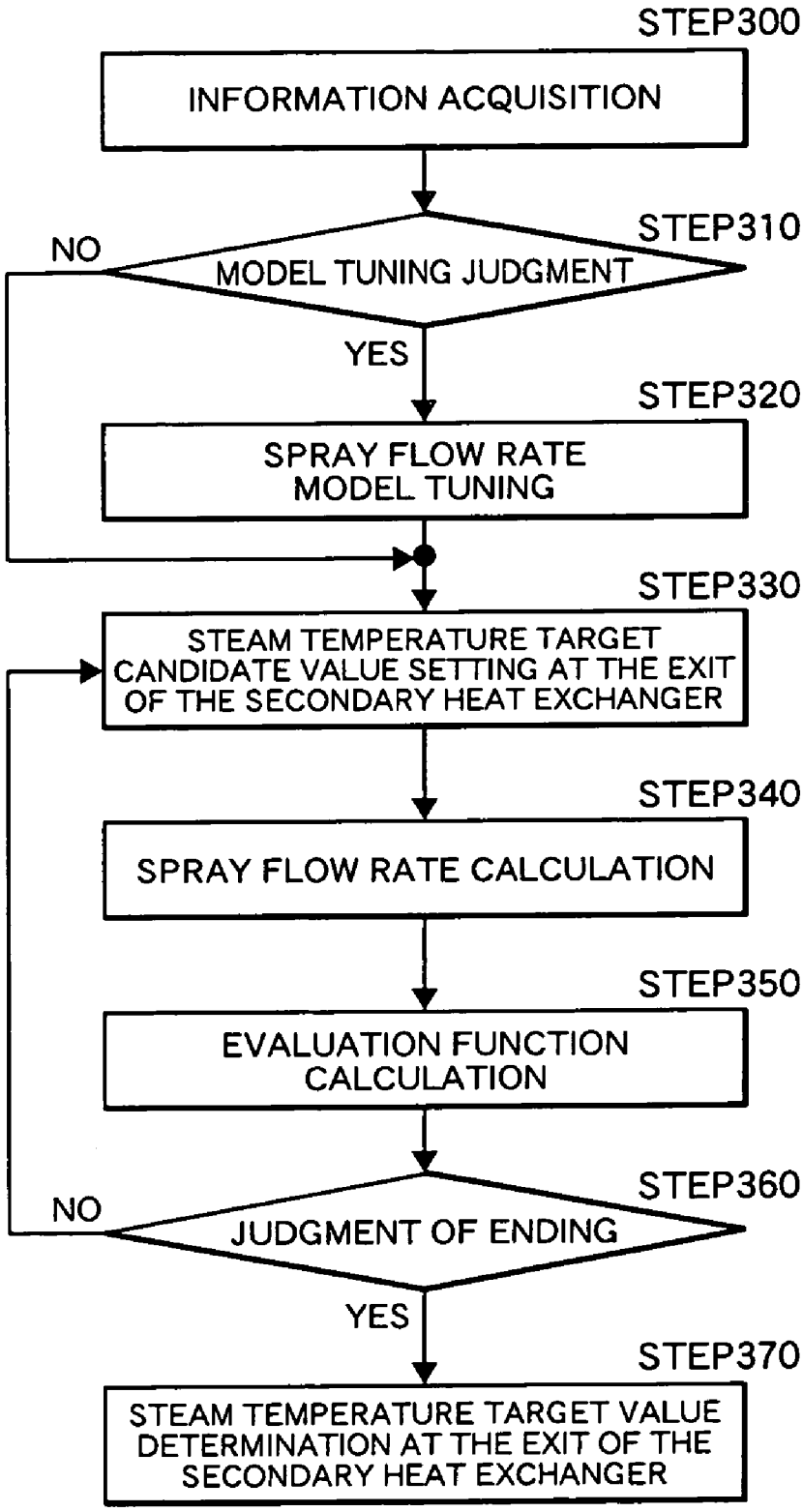
FIG. 8 is a flow chart showing operation procedure for determining the steam temperature target values by a steam temperature target value calculation section of the steam temperature control apparatus of the present invention.

FIG. 8 is a flow chart showing calculation procedure of the steam temperature target values at the steam temperature value calculation section 510.

As shown in FIG. 8, in this embodiment, determination of the steam temperature target values at the steam temperature target value calculation section 510 is carried out by information acquisition (step 300), model adjustment condition decision (step 310), spray flow rate calculation model adjustment (step 320), secondary heat exchanger exit steam temperature target candidate setting (step 330), spray flow rate calculation (step 340), evaluation function calculation (step 350), ending judgment (step 360) and secondary heat exchanger exit steam temperature target value determination (step 370).

In the following, every step of the flow chart shown in FIG. 8 is explained.

In the information acquisition step 300, the steam temperature target calculation section 510 inputs spray flow calculation model stored in the data memory device 250, process values (data table shown in FIG. 6) of the thermal power plant 100 stored in memory unit 273 and operation command value data calculated in the calculation section 272 by means of the abovementioned external input interface 271.

In the next model tuning condition judgment step 310, it is judged whether at least one of a burner pattern, an air flow rate and a fuel flow rate is changed or not, based upon data input at the step 300.

If at least one of the burner pattern, the air flow rate and the fuel flow rate is changed to satisfy the judgment at the step 310, go to the step 320.

On the other hand, if there is no change of the burner pattern, the air flow rate and the fuel flow rate, and the judgment at the step 310 is not satisfied, skip the step 320 and go to the step 330.

In the step 320 where the spray flow rate calculation tuning is conducted, physical constants of the spray calculation model is tuned by a known method, based on detection data acquired from the data detection devices disposed to the thermal power plant 100 (the principle of this tuning employs a technology disclosed in Japanese patent laid-open No. 10-214112, Japanese patent laid-open No. 2001-154705, etc).

The steam temperature target calculation section 510 stores the physical constants in the memory unit 273, and go to step 330.

Then, the step 330 for determining the candidates of steam temperature target values at the exit of the secondary heat exchanger.

At this step 330, the steam temperature target candidate value $T_{SH2-a}(k)$ at the right hand exit 144*b* of the secondary heat exchanger 103 and the steam temperature target candidate value $T_{SH2-b}(k)$ at the right hand exit 144*b* of the secondary heat exchanger 103 are determined in the following procedure.

At first, a thermal adsorption quantity $\Delta J_a$ of the a cycle, a thermal adsorption quantity $\Delta J_b$ of the b cycle in the secondary heat exchanger 103 are calculated by using the equations (5) and (6).

$$\Delta J_a=[F(P_{133a}, T_{116a})\times(G_{cFW}/2-G_{cSP}+G_{cSP2a})]-[F(P_{132a}, T_{115a})\times(G_{cFW}/2-G_{cSP})+F(P_{SP}, T_{SP})\times G_{cSP2a})] \quad (5)$$

$$\Delta J_b=[F(P_{133b}, T_{116b})\times(G_{cFW}/2-G_{cSP}+G_{cSP2b})]-[F(P_{132b}, T_{115b})\times(G_{cFW}/2-G_{cSP})+F(P_{SP}, T_{SP})\times G_{cSP2b})] \quad (6)$$

In the equations (5) and (6), the first term at the right side is a thermal quantity of steam at the exit of the secondary heat exchanger 103. The second term at the right side is a thermal quantity of steam at the entrance of the secondary heat exchanger 103.

F (P, T) is a function for calculation of steam enthalpy at a steam pressure P and a steam temperature T based upon the above mentioned table. $P_{133a}$, $P_{132a}$, $P_{133b}$ and $P_{132b}$ are process values of steam pressure detected by the steam pressure gages 133*a*, 132*a*, 133*b*, 132*b*; $T_{116a}$, $T_{115a}$, $T_{116b}$ and $T_{115b}$ are process values detected by steam thermometers 116*a*, 115*a*, 116*b*, 115*b* and $P_{sp}$ is a spray pressure of the attemperator 107 of the secondary heat exchanger, $T_{sp}$ is a spray water temperature of the attemperator 107 of the secondary heat exchanger, $G_{cFW}$ is a feed water command value, $G_{cSP}$ is a total volume of the spray water in the heat exchanger system and $G_{cSP2a}$ and $G_{cSP2b}$ are spray amounts of the attemperators 107*a*, 107*b* of the secondary heat exchanger.

Next, the steam temperature target candidate values $T_{SH2-a}(k)$, $T_{SH2-b}(k)$ at the exit of the secondary heat exchanger are calculated in accordance with the following equations (7), (8), under the condition that $T_{SH2-a}(k)<T_{SH2-MAX}$, $T_{SH2-b}(k)<T_{SH2-MAX}$ is given as restrictive conditions to the steam temperature target candidate values $T_{SH2-a}(k)$, $T_{SH2-b}(k)$.

$$T_{SH2-a}(k)=T_{SH2-a}(k-1)+(\Delta J_a-0.5\times J_{design})\times\alpha \quad (7)$$

$$T_{SH2-b}(k)=T_{SH2-b}(k-1)+(\Delta J_b-0.5\times J_{design})\times\beta \quad (8)$$

In the above, $T_{SH2-MAX}$ is the maximum value of the steam temperature of steam that passes through the secondary heat exchanger 103, which is determined depending on materials constituting the secondary heat exchanger.

Further, k is the number of repetitions within a calculation cycle for conducting the step 330 for setting the steam temperature target candidates at the exit of the secondary heat exchanger, the step 340 for calculating the spray flow rate, the step 350 for calculating the evaluation function value and the step 360 for ending judgment; α, β are step sizes; $J_{design}$ is a planned value of the thermal adsorption quantity at the secondary heat exchanger 103.

At the step 330, the steam temperature target candidate values at the exit of the secondary heat exchanger are calculated in the above procedure; then go to the step 340.

At the step 340 for calculating the spray flow amount, based upon the target candidate values $T_{SH2-a}(k)$, $T_{SH2-b}(k)$, the spray flow amounts $G_{SP2-a}(k)$, $G_{SP2-b}(k)$ of the attemperators 107 of the secondary heat exchanger, necessary for coinciding with the candidate values and the spray flow amounts $G_{SP3-a}(k)$, $G_{SP3-b}(k)$ of the attemperator 108 of the tertiary heat exchanger, necessary for coinciding the steam temperature at the exit of the tertiary heat exchanger with the target value are given to a spray flow rate calculation model to calculate the target values.

At the step 350 for calculating evaluation function values, the evaluation function Q(k) defined by the equation (9) is calculated.

$$Q(k)=\Gamma_1(G_{SP2-a}(k)-G_{SP2-b}(k))^2+\Gamma_2(G_{SP3-a}(k)-G_{SP3-b}(K))^2+\Gamma_3(T_{SP2-a}(k)-T_{SP2-b}(k))^2 \quad (9)$$

In the above equation, $\Gamma_1\geqq 0$, $\Gamma_2\geqq 0$, $\Gamma_3\geqq 0$ are tuning gains decided by a control system designer. Since the evaluation function Q(k) is calculated by adding the products of the tuning gains with variants of deviation of a spray flow rate and deviation of steam temperature (target candidate), the smaller the deviation of the spray flow rate or the deviation of the steam temperature, the smaller the evaluation function values become.

In the step 360 for ending judgment, when the value of Q(k) calculated at the step 350 is the predetermined value or less, the judgment is satisfied; then go to step 370. At the step 370 for determining the steam temperature target value at the exit of the secondary heat exchanger, $T_{SH2-a}(k)$ and $T_{SH2-b}$ (k) are determined as the steam temperature target values at the exit of the secondary heat exchanger 103.

On the other hand, when the value of the evaluation function Q(k) is larger than the predetermined value, the judgment is not satisfied; then go back to the step 330.

When the time for repeating the step 330 for setting the steam temperature target candidates at the exit of the secondary heat exchanger, the step 340 for calculating the spray flow rate, the step 350 for calculating the evaluation function values, and the step 360 for ending judgment, the judgment is not enough at the step 360 for ending judgment is not enough, the judgment at the step 360 is deemed as being satisfied; at the step 370 for determining the steam temperature target value at the exit of the secondary heat exchanger, the values of $T_{SH2-a}(k)$ and $T_{SH2-b}(k)$ of Q(k) that become the minimum may be determined as the steam temperature target value at the exit of the secondary heat exchanger 103.

It is possible to define the evaluation function Q(k) calculated at the step 350 by the following equation (10).

$$Q(k)=\Gamma_4(V_{SP2-a}(k)-V_{SP2-b}(k))^2+\Gamma_5(V_{SP3-a}(k)-V_{SP3-b}(K))^2+\Gamma_6(T_{SP2-a}(k)-T_{SP2-b}(k))^2 \quad (10)$$

In the above equation, $V_{SP2-a}(k)$ is an opening degree of the spray valve 109*a* of the attemperator of the secondary heat exchanger 107*a* at the time of spraying at the spray flow rate of $G_{SP2-a}(k)$, $V_{SP2-b}(k)$ is an opening degree of the spray valve 109*b* of the attemperator of the secondary heat exchanger 107*a* at the time of spraying at the spray flow rate of $G_{SP2-b}(k)$, $V_{S3-a}(k)$ is an opening degree of the spray valve 110*a* of the attemperator of the tertiary heat exchanger 108*a* at the time of spraying at the spray flow rate of $G_{SP3-a}(k)$, and $V_{SP2-a}(k)$ is an opening degree of the spray valve 110*b* of the attemperator of the tertiary heat exchanger 108*b* at the time of spraying at the spray flow rate of $G_{SP3-b}(k)$. Further, $\Gamma_4 \geqq 0$, $\Gamma_5 \geqq 0$, $\delta_6 \geqq 0$ are tuning gains decided by a designer.

Figure 9:
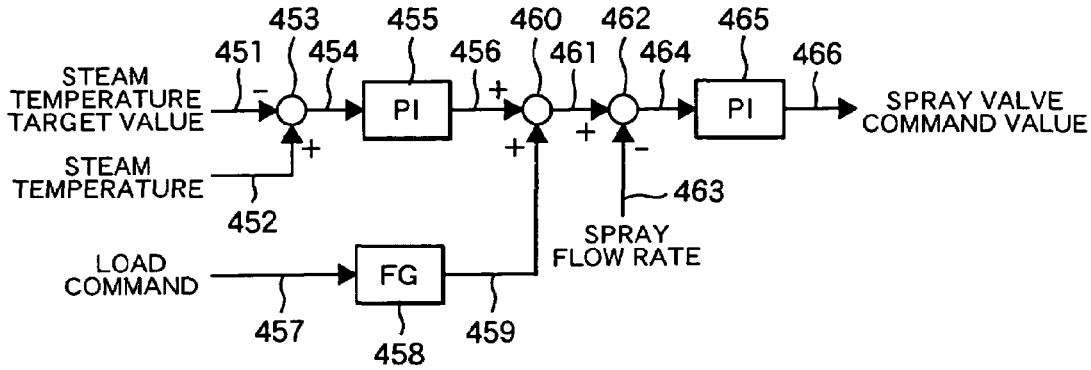
FIG. 9 is a control logic diagram of a spray control command value calculation section disposed to the steam temperature control apparatus of the present invention.

FIG. 9 is a control logic diagram showing the function constitution of spray valve control command calculation section 520 in FIG. 7. The spray valves 109*a*, 109*b* of the attemperators 107*a*, 107*b* are controlled so that the exit steam temperature at the exit of the secondary heat exchanger 103 becomes equal to the steam temperature target value determined at the exit of the secondary heat exchanger 510. The spray valves are controlled by the control logic shown in FIG. 9, for example.

In FIG. 9, the target value of the spray flow rate 461 is produced by adding an amended amount 456 of the spray flow rate to the standard amount 459 of the spray flow rate calculated from an output of the non-linear function (FG) as an input command of a load command 457. The amended amount 456 of the spray flow rate is produced from the output of the proportional integration (PI) controller 455 to which a deviation 454 between the steam temperature target value 451 and steam temperature 452 is input. A deviation 464 between the spray flow rate 463 introduced into the plant and the target value 461 of the spray flow rate is calculated; a spray valve command value 466 is calculated from the output of the PI controller 465 to which the deviation 464 is input.

At the spray command calculation section 520, the spray flow rates $G_{SP2-a}(k)$ and $G_{SP2-b}(k)$ of the secondary heat exchanger and the spray flow rates $G_{SP3-a}(k)$ and $G_{SP3-b}(k)$ of the tertiary heat exchanger calculated by the steam temperature target calculation section 510 are set as the spray target values, thereby to control the spray valves.

Figure 10:
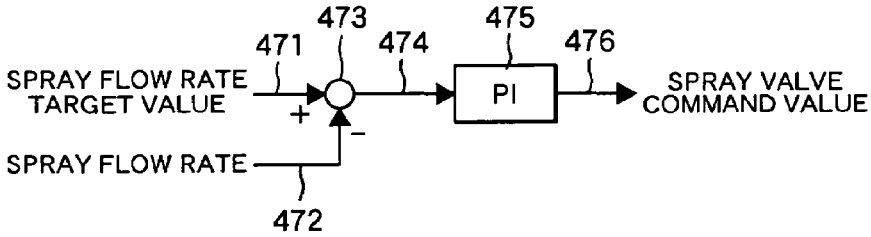
FIG. 10 is a control logic diagram of a spray control command value in the steam temperature control apparatus of another embodiment of the present invention.

In FIG. 10, the spray valve command value 476 is produced by the output of the PI controller 476 as an input of the deviation between the spray flow rate target value 471 and the spray flow rate 472.

In the following, functions and advantages of the embodiments of the present invention are explained.

Steam temperature targets are set to the respective steam pipes connected to the common heat exchanger and spray valves for spraying water into steam flowing through the steam pipes are controlled so that the advantages explained in the following will be obtained.

A value of the evaluation function Q(k) of the equation (9) calculated at the step 350 for calculating the evaluation function becomes smaller as the difference between the spray flow rate or steam temperature between the a cycle and b cycle become small. This is because when the difference ($=G_{SP2-a}(k)-G_{SP2-b}(k)$) in the spray flow rates of the attemperator 107 of the secondary heat exchanger between the a cycle and the b cycle is small, the value of the first term of the evaluation function Q(k) becomes small. Since the difference in the exit steam temperature of the secondary heat exchanger 104 is $T_{SH2-a}(k)-T_{SH2-b}(k)$, the values of the second and third terms of the evaluation function Q(k) become small as the above values are small.

Figure 11:
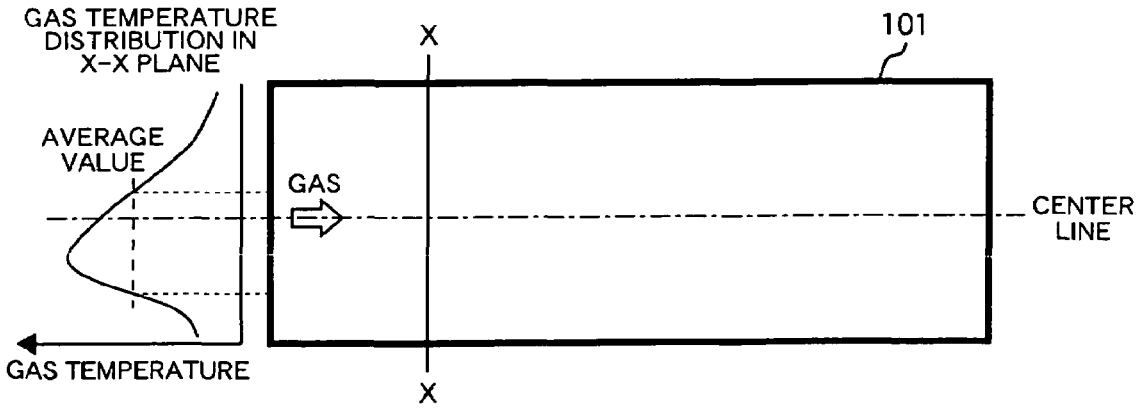
FIG. 11 shows a temperature distribution at the chimney of the boiler.
Figure 12A:
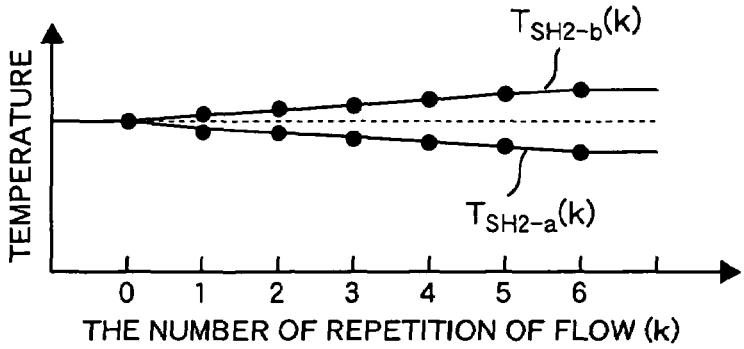
FIGS. 12*a* through 12*d* show evaluation function judgment of the steam temperature control system of the invention.
Figure 12B:
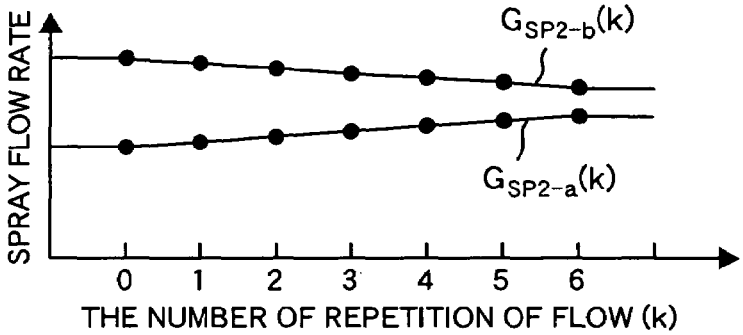
Figure 12C:
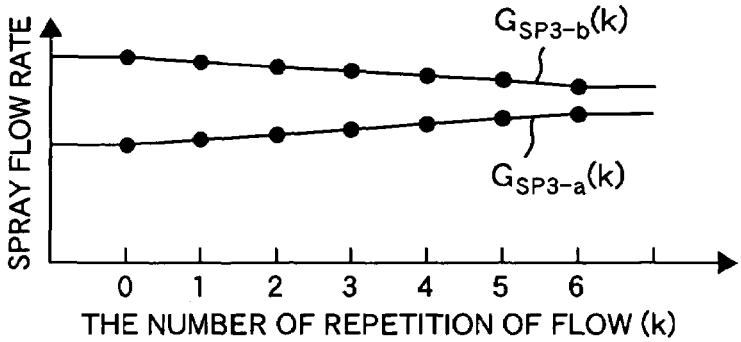
Figure 12D:
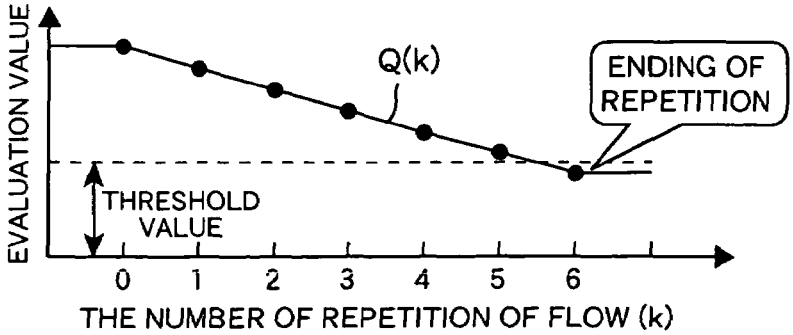

For example, consider the case where temperature distribution of gas flowing through the chimney 52 is one shown in FIG. 11, when ignition, blowing-off, etc of the burners are practiced. In FIG. 11, the gas temperature in the right hand (a lower side in the drawing) of the center of the chimney 52 is higher than in the left hand (an upper side in the drawing). In this case, steam passing through the heat exchanger arranged at the right side of the chimney has a thermal adsorption amount larger than that of steam passing through the left hand of the chimney, even if one heat exchanger is disposed. That is, steam in the b cycle has a larger thermal adsorption value.

Here, consider a basic method of controlling the spray valve 109 of the attemperator of the secondary heat exchanger wherein the exit steam temperature of the a cycle in the secondary heat exchanger 103 is controlled by the spray valve 109 of the attemperator of the secondary heat exchanger 107*a* and the exit steam temperature of the b cycle in the secondary heat exchanger 103 is controlled by the spray valve 109*b* of the attemperator of the secondary heat exchanger, independently. In this case, if the target values of the exit steam temperature of the secondary heat exchanger in the both cycles are set to be the same, a spray amount for making the steam temperature constant in the b cycle is larger than that in the a cycle, since the thermal adsorption amount in the b cycle is larger than the other.

As for the tertiary heat exchanger 104, in the same reason as in the above, the spray flow amount in the attemperator 108*b* of the tertiary heat exchanger is larger than that in the attemperator 108*a*. As a result, the operation allowance for the spray valve 107*b* of the attemperator 107*b* of the secondary heat exchanger and the spray valve 110*b* of the attemperator 108*b* of the tertiary heat exchanger become smaller, and the evaluation function Q(k) becomes larger.

On the other hand, in the steam temperature control apparatus 200, since the control command values for the spray valves are calculated by comparing evaluation function values as a variant of a deviation of the steam temperature or a deviation of the spray flow rate with a threshold value, a deviation of the spray flow rates of the respective steam pipes 51 is alleviated. That is, the target value of the exit steam temperature of the secondary heat exchanger in the b cycle where the thermal adsorption amount is large is increased to the extent that it does not exceed an allowable temperature of the heat exchanger so that the target value of the exit steam temperature of the secondary heat exchanger is lowered. As a result, the spray flow rate of the attemperator 107*b* of the secondary heat exchanger decreases and the spray flow rate of the attemperator 107*a* of the secondary heat exchanger increases; the difference in the spray flow rates in the secondary heat exchanger becomes small.

At the exit of the secondary heat exchanger 103, a difference in the spray flow rates in the attemperator 108 of the tertiary heat exchanger can be made small when the steam temperature target value of the b cycle is set to be higher than that of the a cycle. That is, steam having a high temperature, which has passed through the b cycle of the secondary heat exchanger 103 passes through the a cycle whose gas temperature is low.

On the other hand, steam having a low temperature, which has passed through the a cycle of the secondary heat exchanger 103 passes through the a cycle, having a high temperature, in the tertiary heat exchanger 104. As a result, the spray flow rate of the tertiary heat exchanger 108*a* increases and the spray flow rate of the attemperator 108*b* becomes low, compared with the case where the exit temperature of the both cycles of the secondary heat exchanger 103 is kept the same. Accordingly, the difference in the spray low amounts among the steam pipes 51 in the tertiary heat exchanger 108 is alleviated. If the difference in the spray flow amounts among the steam pipes 51 is alleviated, allowance for operation of the attemperator 108*b* of the tertiary heat exchanger and the secondary heat exchanger becomes large.

FIG. 12 shows (a) relationship between temperature and steam temperature set value at the secondary heat exchanger exit, (b) relationship between a spray flow rate and an amount of spray flow rate of an attemperator of the secondary heat exchanger, (c) relationship between a spray flow rate and an amount of spray flow rate of an attemperator of the tertiary heat exchanger and (d) relationship between an evaluation value and the evaluation value of repetition number of the flow rate, wherein there are shown relationships between the number (k) of repetition for repeating the steps 330 for steam temperature target candidate setting at the exit of the secondary heat exchanger to the step 360 for judging ending and steam temperature target candidate values $T_{SH2-a}(k)$, $T_{SH2-b}(k)$ at the exit of the secondary heat exchanger 103, calculated values $G_{SP2-a}(k)$, $G_{SP2-b}(k)$ of the spray flow rates of the secondary heat exchanger, calculated values $G_{SP3-a}(k)$, $G_{SP3-b}(k)$ of the spray flow rates of the tertiary heat exchanger, and evaluation function Q (k).

The flow shown in FIG. 8 is repeated to set $T_{SH2-b}(k)$ higher than $T_{SH2-a}(k)$ so that the values of $G_{SP2-a}(k)-G_{SP2-b}(k)$ and $G_{SP3-a}(k)-G_{SP3-b}(k)$ become small and the evaluation function Q (k) becomes small.

Figure 13:
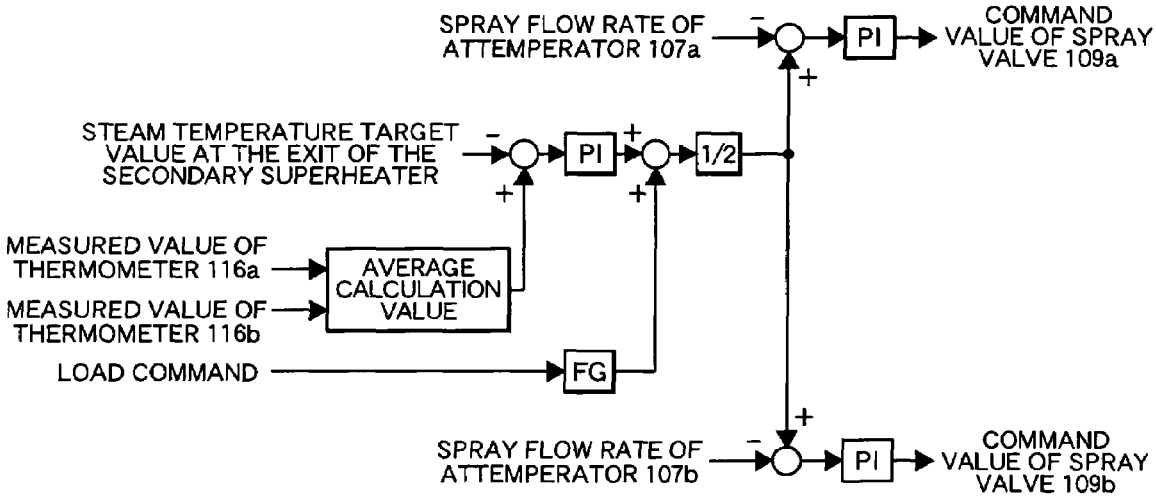
FIG. 13 is a control logic of the spray valve control of another embodiment.

On the other hand, another basic method for controlling the spray valve 109 of the attemperator of the secondary heat exchanger may employ the constitution shown in FIG. 13. In this method, an average value of the steam temperature at the exit in the a cycle and the b cycle of the secondary heat exchanger 103; the spray flow rate of the attemperator 107 of the secondary heat exchanger is determined by a deviation of the average value and the steam temperature target value of the secondary heat exchanger. Then, the resulting spray flow rate is divided into two 107*a* and 107*b*. In this control method, when the spray valve 109 of the secondary heat exchanger is controlled in the case where there is a gas temperature distribution shown in FIG. 11, the steam temperature at the exit of the secondary heat exchanger in the b cycle is higher than that in the a cycle. Although there is no difference in the spray flow rate of the attemperator 107 of the secondary heat exchanger, the value of the evaluation function Q (k) becomes large because the difference in the steam temperature at the exit of the secondary heat exchanger 107 between the a cycle and the b cycle. Further, there is a possibility that the steam temperature at the exit of the b cycle of the secondary heat exchanger 103 may exceed the steam temperature allowance value $T_{SH2-MAX}$ at the exit of the b cycle of the secondary heat exchanger 103.

Even in this basic control method, the present embodiment that employs setting the steam target temperature values with respective steam pipes is effective. That is, according to this embodiment, the target steam temperature at the exit of the b cycle becomes higher; if the temperature exceeds the allowed temperature of the heat exchanger, the spray flow rate of the attemperator 107*b* of the secondary heat exchanger, which is necessary for the steam temperature at the exit of the secondary heat exchanger that does not exceed the allowed temperature of the heat exchanger, is controlled by the flow control shown in FIG. 8. As a result, the spray valve 109*b* of the attemperator of the secondary heat exchanger is controlled, whereby the steam temperature at the exit of the b cycle of the secondary heat exchanger lowers.

As is explained above, in the present embodiment, if there is a great unbalance of the spray flow rates, the control system works to remove the unbalance thereby to secure the operation allowance of the spray valves 109, 110 of the attemperators. Further, the steam temperature does not exceed the allowed temperature of the heat exchanger.

According to the present embodiment, since it is possible to secure allowance with respect to the operation limit of the attemperator, the control performance of the steam temperature at the load change operation can be improved to thereby prevent the steam pipes from being damaged.

The steam temperature control system of the present invention may be applied to other power plants that have steam generation means in addition to the thermal power plant described above.

Figure 14:
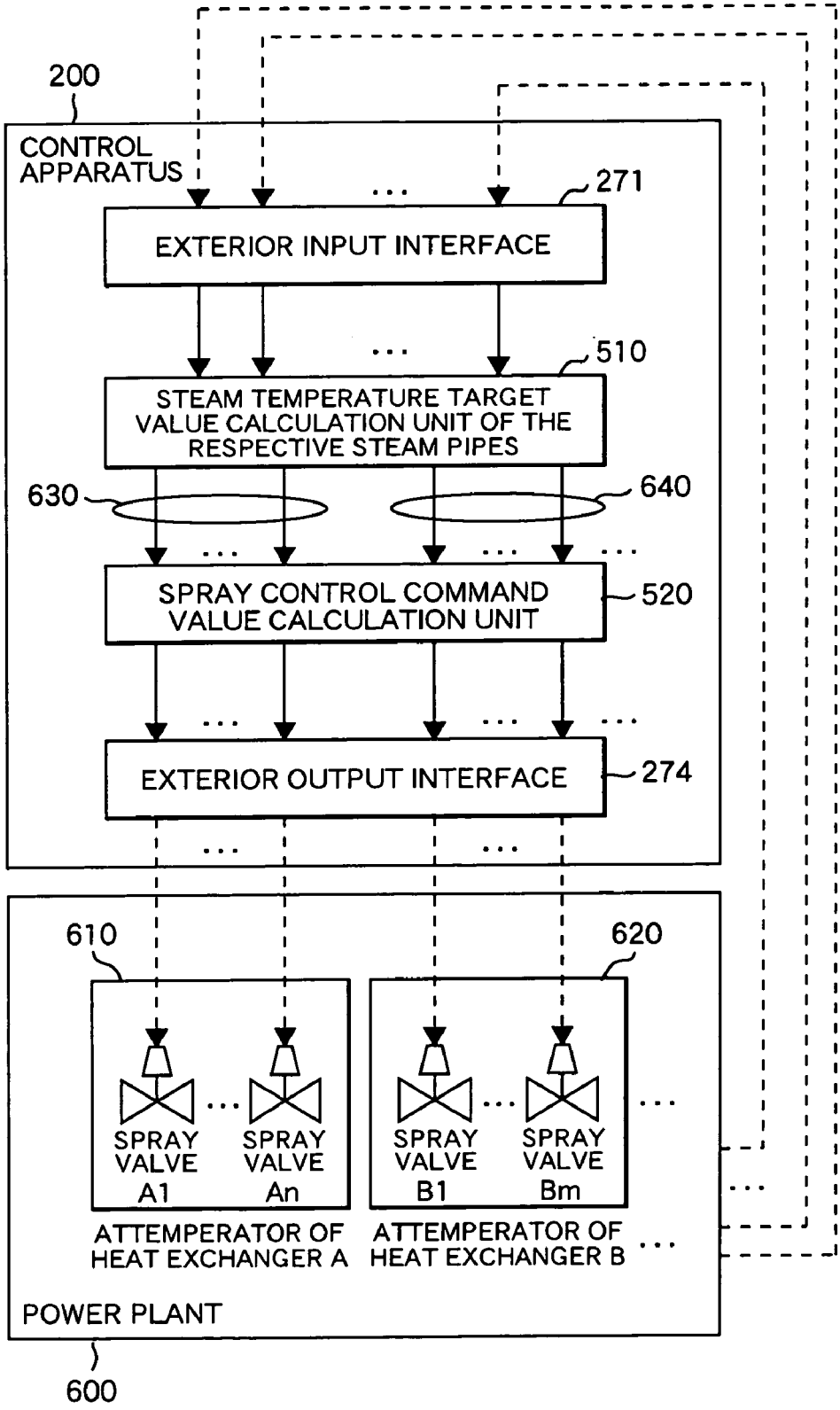
FIG. 14 is a block diagram of an example of application of the steam temperature control system to a power plant.

FIG. 14 is a diagram showing an application of the steam temperature control system of the present invention to a power plant. In this figure, the same reference numerals as in the previous figures denote the same members and explanations thereof are omitted. In FIG. 14, the power plant 100 is provided with heat exchangers A, B, . . . and attemperators 610, 620, . . . each disposed to steam pipes (not shown) of each of the heat exchangers.

In FIG. 14, the temperature of steam passing through n steam pipes connected to the heat exchanger A is controlled by spray water from the spray valve $A_1$, $A_2$, . . . An of the attemperator 610 disposed to each of n steam pipes; steam temperature of m steam pipes connected to the heat exchanger B is controlled by the spray valves $B_1$, $B_2$, . . . Bm connected to the m steam pipes. Though the heat exchangers A, B are shown in FIG. 14, other heat exchangers may be arranged. Further, the attemperators are not always disposed to all steam pipes.

BY disposing the steam temperature apparatus 200 of the present invention to the power plant 600, the steam temperature target 630 of each of the steam pipes connected to the exit of the heat exchangers A, B is set by the steam temperature target value calculation section 510; using these steam temperature targets, the spray valves $A_1$, $A_2$, . . . An of the attemperators 610 and the spray valves $B_1$, $B_2$, . . . Bm are controlled. BY giving targets to one heat exchanger, the control system works to remove the unbalance when the unbalance of the spray flow rates is large. As a result, it is possible to secure operation allowance of spray valves $A_1, \ldots An, B_1, \ldots Bm$, and the steam temperature does not exceed the allowed temperature of the heat exchanger.

In the above description, the evaluation function Q(k) has a variant comprising a deviation of spray flow rates of the respective spray valves disposed to the steam pipes connected to the common heat exchanger and a deviation of steam temperature of steam flowing through the steam pipes. As long as the principal advantages of the present invention are achieved, only one of the deviations may be used as a variant.

If the function is one that one of the variants is small, the answer becomes small, it is possible to secure allowance for operation limit of the attemperator by conducting the procedure shown in FIG. 8, as a parameter the evaluation function values derived from the function. As a result, it is possible to improve control performance of steam temperature at the time of load change operation. It is further possible to avoid that steam temperature locally increases over the limit temperature of the heat exchanger thereby to prevent the steam pipes from damage.

What is claimed is:

1. A steam temperature control system for a power plant for controlling a temperature of steam flowing through steam pipes connected to a heat exchanger to a target temperature by spraying water by means of a spray valve of an attemperator, which comprises:

a target temperature calculation section for calculating the target temperature of the steam for determining the target temperatures of the plural steam pipes connected to the heat exchanger in respective steam pipes connected to a common heat exchanger; and an instruction value calculation section for calculating command values to the spray valves disposed to the respective steam pipes, based on the target temperatures determined by the calculation in the target temperature calculating section.

2. The steam temperature control system according to claim 1, wherein the target temperature calculation section determines the steam target temperature value of the respective steam pipes, based on the limit values of the steam temperature and the operation allowance of an opening degree of the spray valves.

3. The steam temperature control system according to claim 1, wherein the target temperature calculation section determines the steam temperature target values of the respective steam pipes, based on parameters of evaluation function values derived as a variant from at least one of a deviation of a spray flow rate through the spray valve disposed to the respective steam pipes and a deviation of temperature of steam flowing through the steam pipes.

4. The steam temperature control system according to claim 1, wherein the following steps are carried out in order.

(1) setting candidate values of steam temperature target of the respective steam pipes connected to a common heat exchanger;

(2) based upon the candidate values of steam temperature targets, setting a spray flow amount of each of the spray valves disposed to each of the steam pipes;

(3) deriving an evaluation function value as a variant from at least one of a deviation of the set spray flow rate and a deviation of the candidate of steam temperature targets;

(4) comparing the derived evaluation values with a threshold value to determine steam temperature targets of the respective steam pipes; and (5) based upon the determined steam temperature target values of the respective steam pipes, calculating a command value against the spray valves disposed each of the steam pipes.

5. A method of controlling a steam temperature of a power plant, which controls a steam temperature to a target temperature of steam flowing through steam pipes connected to a heat exchanger by spraying spray water against valves of an attemperator, comprising:

determining steam temperature target values of respective steam pipes connected to a common heat exchanger; and based upon the determined steam temperature target value of the respective steam pipes, calculating control command values against the spray valves disposed to each of the steam pipes.

6. The method of controlling a steam temperature of a power plant according to claim 5, wherein the steam temperature target value is determined by taking into consideration operation allowance of the opening degree of the spray valves and limited values of the steam temperature.

7. The method of controlling a steam temperature of a power plant according to claim 5, wherein the steam temperature target values of the respective steam pipes are determined by evaluated function values derived as a variant from at least one of a deviation of the spray flow rate in the spray valve disposed to each of the steam pipes and a deviation of temperature of steam flowing the pipes as a criterion.

8. The method of controlling a steam temperature of a power plant according to claim 5, wherein a steam temperature target candidates of the respective steam pipes connected to the common heat exchanger are set; a spray flow rate of each of the steam valves disposed to each of the steam pipes is set;

at least one of the deviation of the set spray flow rates and the deviation of the steam temperature target candidate are derived as a variant;

steam temperature target values of the respective steam pipes are determined by comparing the derived evaluation function values with the threshold values; and based on the respective determined steam temperature target values of the steam pipes, control command values to the spray valves disposed to the steam pipes are calculated.

9. A power plant comprising:

a heat source for generating steam by heating feed water;

at least one heat exchanger disposed to the heat source;

steam pipes connected to the heat exchanger;

a pair of attemperators for adjusting temperature of steam flowing, the steam pipes when spray water is sprayed by spray valves disposed to the respective steam pipes;

a steam temperature target value calculating section for determining steam temperature target values of the respective steam pipes; and a spray control command value calculating section for calculating control command values to the spray valves disposed to the respective steam pipes, based on the steam temperature target values of the respective steam pipes determined by the steam temperature target value calculating section.

10. The power plant according to claim 9, wherein the steam temperature target value calculating section determines the steam temperature target values in considering operation allowance of an opening degree of the spray valve and limited values of the steam temperature with respect to the steam pipes.

11. The power plant according to claim 9, wherein the steam temperature target value calculating section determines the steam temperature target values based upon a parameter of evaluation function values derived as a variant from a deviation of a spray flow rate by the spray valve disposed to the respective steam pipes or a temperature deviation of the steam flowing the steam pipes.

12. The power plant according to claim 9, which further comprises a steam temperature control device that conducts the following steps:

(1) a step for setting steam temperature target candidates of the respective steam pipes;

(2) a step for setting a spray flow rate of each of the spray valves disposed to the respective steam pipes, based upon the set steam temperature target candidates;

(3) a step for deriving evaluating function values as a variant of at least one of deviation of the spray flow rates and deviation of the steam temperature target candidates;

(4) a step for determining the steam temperature target values by comparing the derived evaluation function values with a threshold value; and (5) a step for calculating control command values with respect to the spray valves disposed to the respective steam pipes, based upon the determined steam temperature target values of the respective steam pipes.

* * * * *